United States Patent [19]

Lewis et al.

[11] 4,251,716

[45] Feb. 17, 1981

[54] SELF-CLEANING GLASS-CERAMIC SURFACE COOKING UNIT

[75] Inventors: Walter E. Lewis; Bohdan Hurko, both of Louisville, Ky.

[73] Assignee: General Electric Company, Louisville, Ky.

[21] Appl. No.: 964,999

[22] Filed: Nov. 30, 1978

[51] Int. Cl.[3] ..... H05B 3/06

[52] U.S. Cl. ..... 219/446; 219/464; 219/451; 219/398; 219/413

[58] Field of Search ..... 219/446, 506, 543, 396, 219/397, 398, 413, 414, 445, 462, 464–467

[56] References Cited

U.S. PATENT DOCUMENTS

| | | | |
|---|---|---|---|
| 2,007,876 | 7/1935 | Sauvage | 219/446 |
| 2,224,945 | 12/1940 | Ames . | |
| 2,413,478 | 12/1946 | Wiegand | 219/445 |
| 2,681,973 | 6/1954 | Macoicz | 219/506 |
| 2,823,290 | 2/1958 | Warner | 219/446 |
| 2,918,558 | 12/1959 | Evans | 219/506 |
| 3,121,158 | 2/1964 | Hurko . | |
| 3,176,099 | 3/1965 | Bergsma | 337/126 |
| 3,413,445 | 11/1968 | Dills | 219/396 |
| 3,636,309 | 1/1972 | Deaton et al. | 219/452 |
| 3,941,975 | 3/1976 | Newman | 219/543 |
| 4,032,750 | 6/1977 | Hurko | 219/464 |
| 4,127,858 | 11/1978 | Gardner et al. | 219/506 |

*Primary Examiner*—Thomas J. Kozma
*Assistant Examiner*—Bernard Roskoski
*Attorney, Agent, or Firm*—Bernard J. Lacomis; Radford M. Reams

[57] ABSTRACT

An automatic cleaning arrangement for a glass-ceramic cooking surface which is adapted to remove baked-on soils from the surface regions surrounding the individual cooking areas by the process of oxidation. Additional thin film heaters are located under the regions to be cleaned and are activated by a timer controlled power supply circuit. An interlock switch in the cook heater line disables the cook heater when the cleaning operation is in progress. The power supply circuit for the thin film heaters is arranged to disable automatically the cooking heaters when a break occurs in the glass-ceramic surface in the region of the thin film heaters.

13 Claims, 5 Drawing Figures

SELF-CLEANING GLASS-CERAMIC SURFACE COOKING UNIT

BACKGROUND OF INVENTION

This invention relates to an electric range of the type having a glass-ceramic cooking surface and, more particularly, to a range of this type in which provision is made to maintain the cooking surface in a clean condition.

Electric ranges with glass-ceramic cooking surfaces have been on the market for a number of years and have achieved a significant measure of commercial success, principally because of the attractiveness of the smooth surface and because of the apparent ease of cleaning as compared to ranges using conventional sheathed heaters. It has been found in practice, however, that the glass-ceramic surface has a tendency to become soiled with baked-on food soils which are not readily removable. Special cleaning compounds have been made available in an effort to assist in the cleaning of the surface but they have not proven entirely satisfactory since they require a significant amount of effort to use and, being somewhat abrasive, they have a tendency to scratch and mar the surface after repeated usage.

It is, therefore, an object of the present invention to provide a glass-ceramic cooktop surface that is easily cleaned by the housewife using electrical circuitry built into range or cooktop unit.

It is a further object of the present invention to provide apparatus for removing baked-on food soils from the surface of a glass-ceramic cooktop without scratching or otherwise marring the surface.

It is a still further object of the present invention to provide apparatus which automatically "self-cleans" food soils from a glass-ceramic cooktop surface while at the same time doubling as a feature which serves to indicate the existence of cracks in the glass-ceramic surface.

Further objects and advantages of the present invention will be apparent from the following description, reference being had to the accompanying drawings wherein a preferred embodiment of the invention is shown.

DETAILED DESCRIPTION OF THE INVENTION

Figure 1:
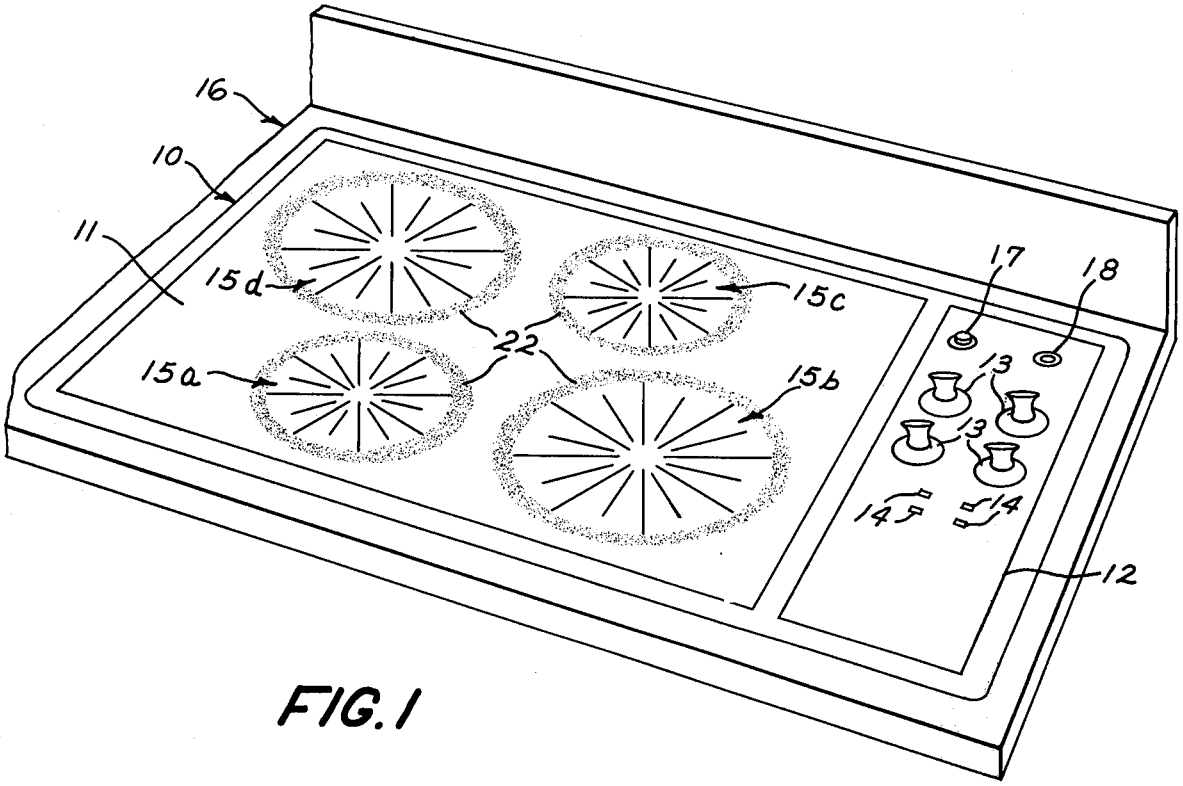
FIG. 1 is a perspective view of a cooktop embodying a glass-ceramic surface useful in describing one form of the present invention.

Referring to FIG. 1, there is shown a cooktop unit 10 comprising a conventional planar glass-ceramic cooktop surface 11 and a control panel 12, the latter incorporating cooking temperature controls 13, and indicator lights 14 to indicate the "on" condition of the cooking heaters. A plurality of generally circular areas **15*a*–15*d* adapted to orient and support cooking utensils during normal cooking operations are provided and delineated in conventional manner by radial lines as indicated. The cooktop unit 10 is shown in the form of a built-in unit mounted in the counter top 16 of a kitchen cabinet, however, it will be understood that a cook unit incorporating the present invention may be embodied in other arrangements such as the cooking surface atop the oven of a free standing range. A control device 17, such as a pushbutton 17 or rotary knob, and a neon glow bulb indicator light 18 may also be included on the control panel 14** for reasons described hereinafter.

Figure 2:
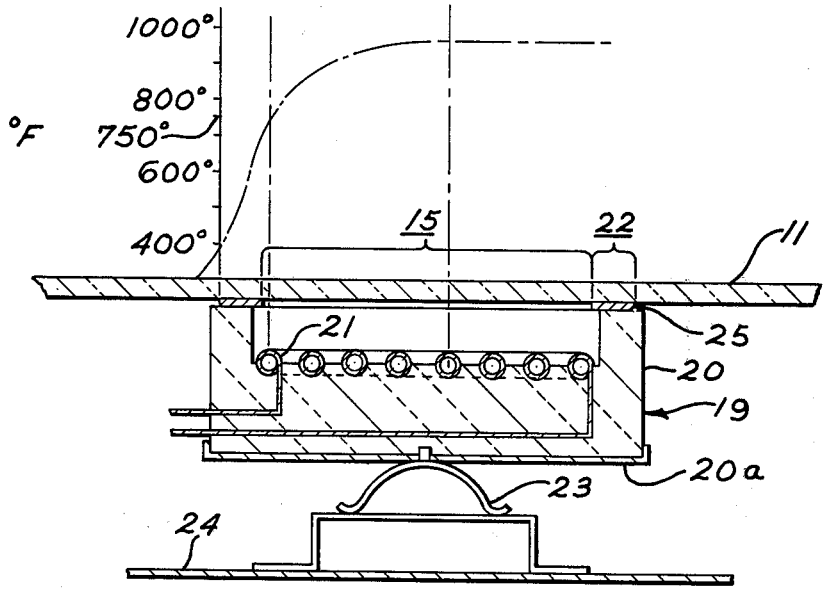
FIG. 2 is a side view in section of a single cooking unit constructed in accordance with one form of the present invention and includes a temperature curve useful in explaining the operation of the invention.

Referring to FIG. 2, a cooking heater unit 19 is shown mounted under glass-ceramic surface 11. Typically, heater unit 19 comprises a heater insulation block 20 of suitable refactory material in which a conventional spiral wound open coil heater wire 21 is nested in mating grooves. Heater block 20 is mounted on a metal support plate **20*a* and urged against the underside of surface 11 by a conventional bias spring arrangement 23 resting on the lower portion 24 of the cooktop unit 10. Heater coil 21 underlies the cooking area 15 and serves, when activated, to bring the surface temperature of the cooking area 15** to a level selected by the user which is appropriate for the desired cooking operation. Typically this temperature will exceed 750° F. and can range from 750° F. to about 1000° F.

A temperature gradient curve is shown in FIG. 2 above the cooking area 15 which illustrates the kind of temperature distribution that can be evidenced on the glass-ceramic surface 11 when the heater is energized at full power at no load condition, i.e. without a pan on the surface. It will be noted that the glass-ceramic temperature drops very sharply in the region 22 adjacent the cooking area 15 heated by coil 21. As can be seen, the temperature in this region 22 ranges between 400° F. and 750° F. At these temperatures, food soils, such as grease sputterings, bake on forming a ring of black varnish-like coating in region 22. The width of this coating will vary depending on the particular design of the cooktop unit but is generally in the range of from approximately one-half to three-quarters inch in width extending around the periphery of the cooking area 15. Within the cooking area 15 the surface remains clean because the temperature of the surface in this area reaches into the 750° F.–1000° F. range, under no-load conditions, which is sufficient to cause the food soils to oxidize, in accordance with well known principles, and thereby be removed. Outside the region 22, the surface temperature does not reach into the 400°–750° range at which soils become baked on and, therefore, these remote areas are easily cleaned by wiping with a damp, soapy cloth.

Figure 3:
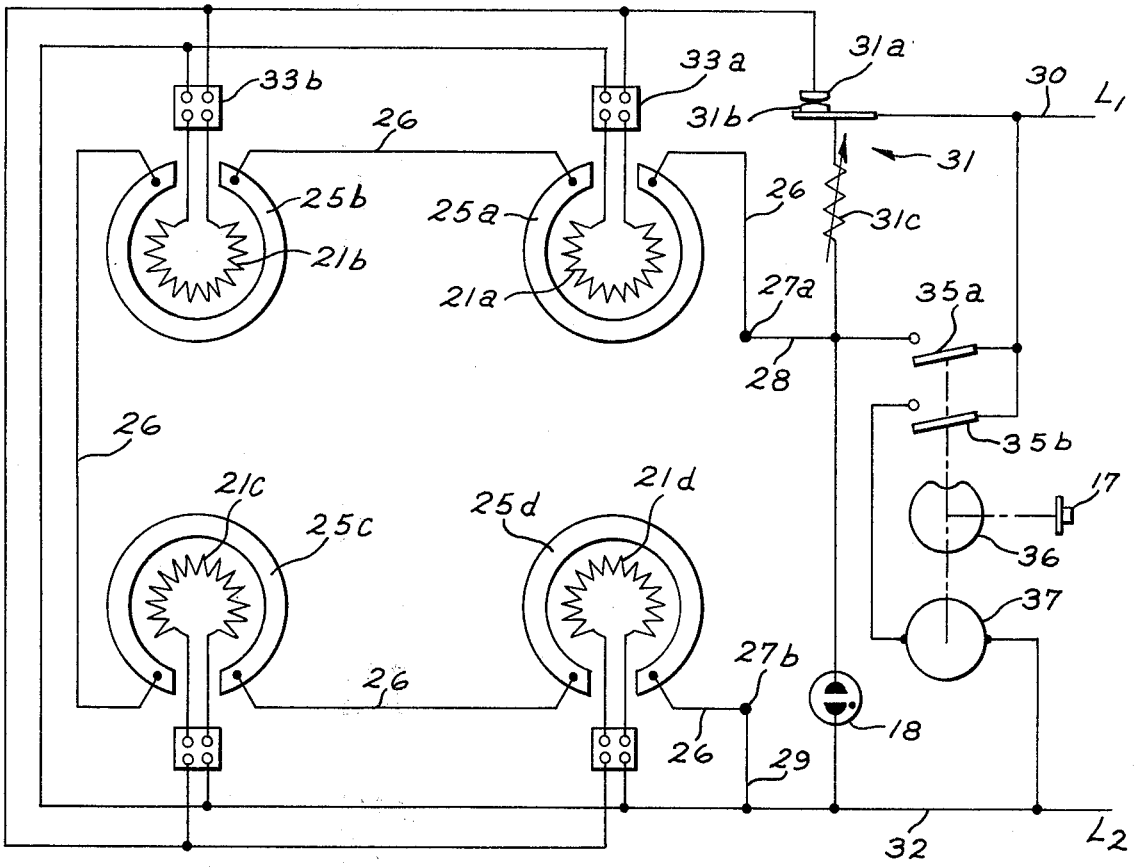
FIG. 3 is a schematic illustration of an electric circuit useful in the construction and operation of one form of the present invention.
Figure 4:
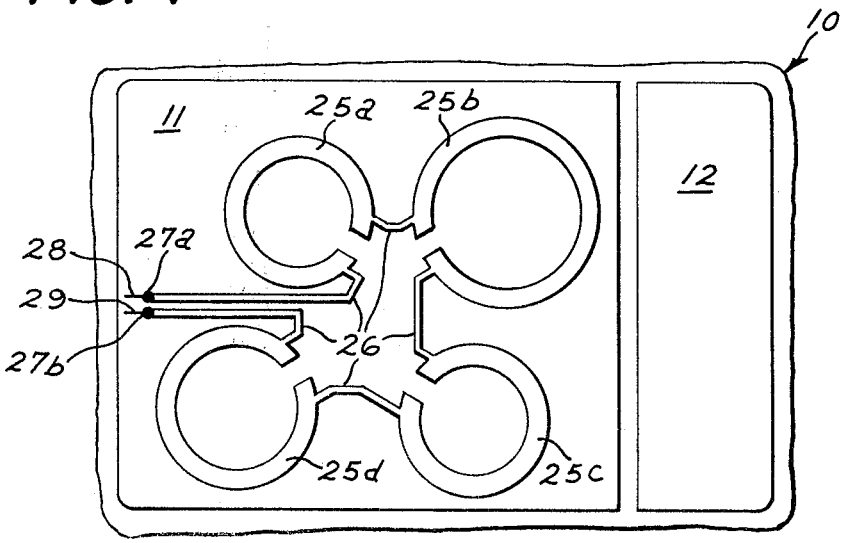
FIG. 4 is a plan view of the underside of the FIG. 1 cooktop surface illustrating an embodiment of the present invention.

In accordance with the invention, the baked-on food soils in region 22 are caused to be cleaned automatically. To this end, and with reference to FIGS. 2–4, the cooktop unit 10 further includes additional electric heating means oriented in thermal contact with region 22 of the glass-ceramic surface and circuit means for supplying electric energy to the additional heating means to raise the surface temperature in region 22 to a level sufficient to remove the baked-on food soils deposited in region 22 during one or more prior cooking operations. As shown in FIGS. 2 and 3, rings of thin film heaters 25a–25d are deposited on the underside of glass-ceramic surface 11 directly beneath the regions adjacent each of the cooking areas 15a –15d. The film heaters are deposited in a conventional manner and are interconnected in series by silver paste interconnections 26, the end terminals 27a, 27b of which are connected by solder connections to external lead wires 28, 29.

Considering the schematic circuit diagram of FIG. 3, input power is supplied to the cook heaters 21a–21d from terminals $L_1$ and $L_2$ via power input lines 30, 32, interlock switch contacts 31a and 31b of a conventional hot wire relay 31 and conventional infinite heat temperature control switches 33a–33d. Hot wire relay 31 may be of the type shown in U.S. Pat. No. 3,176,099—Bergsma. The activator wire 31c of relay 31 is connected from input line 30 through the low impedance series connection of thin film heaters 25a–25d to the other input line 32. An indicator light 18 mounted on control panel 12 and preferably of the neon glow type, is connected in parallel across the series branch of thin film heaters 25a–25d and in series with activator wire 31c across the power inputs $L_1$ and $L_2$.

Means for supplying electric energy to the thin film heaters 25a–25d comprises a timer controlled switch 35a coupled in parallel across activator wire 31c and leading from input line 30 to the input terminal 27a of the thin film heaters 25a–25d. Timer switches 35a and 35b are both closed by the initial rotation of cam 36 caused by the action of pushbutton 17 on control panel 12. When closed, power from input lines 30, 32 is applied directly across timer motor 37 via switch 37b which operates to rotate cam 36 until switch 35b is opened at which time the power to the timer motor is interrupted.

In operation, when it is desired to remove baked-on soils from region 22 around each cooking area, the user pushes button 17 to close switch 35a thus bypassing activator wire 31c and applying full input power across the thin film heaters 25a–25d. Power is also applied across neon bulb 18 indicating the cleaning operation is in effect. At the same time, the bypassing of activator wire 31c causes interlock switch contacts 31a, 31b to open thus disabling the cooking heaters for the duration of the cleaning operation.

In accordance with one specific aspect of this present invention, the total impedance of the series connected thin film heaters 25a–25d is low, on the order of 45 ohms, while the impedance of neon bulb 18 is substantially higher, on the order of

6,000–10,000 ohms. The impedance of activator wire 31c is preferably intermediate that of the thin film heaters 25a–25d and bulb 18 and may, for example, be on the order of 800 ohms. With this arrangement the thin film heaters 25a–25d will also serve to provide an indication of a crack or break in the glass-ceramic surface which may extend through any of the regions 22. Such a crack or break opens the low impedance thin film heater branch and places activator wire 31c in series with the high impedance neon bulb 18. When this occurs, substantially all of the input voltage appears across the high impedance of bulb 18 causing it to light even though no cleaning operation has been selected. Additionally, the substantial drop in current passing through activator wire 31c causes the interlock switch 31 to open thus rendering cook heaters 21a–21d inoperable. Both of these conditions serve automatically as a warning indication to the user that the glass-ceramic surface is broken and that repair service is necessary.

Figure 5:
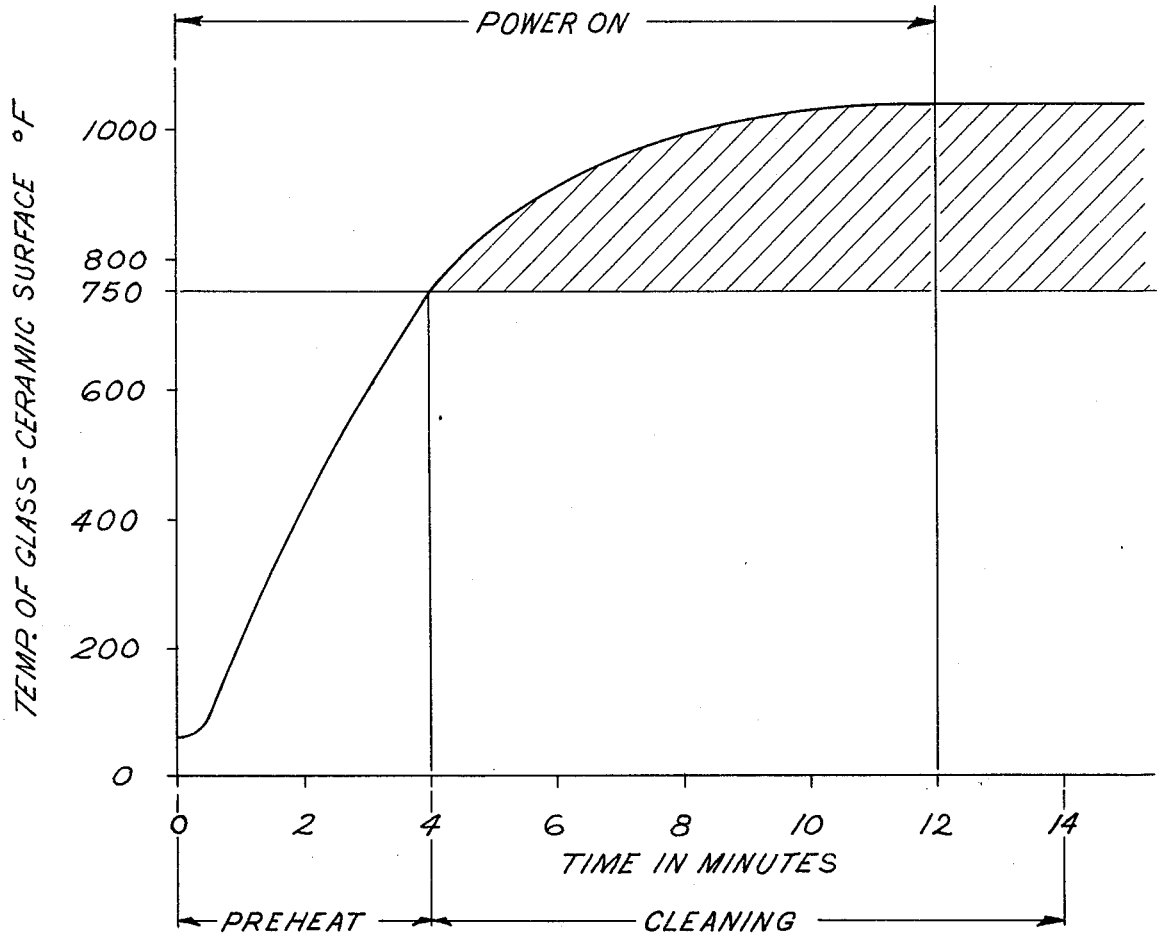
FIG. 5 is a graph illustrating the operation of a clean cycle performed in accordance with an embodiment of the present invention.

The time required to clean baked-on food soils from the glass-ceramic surface will depend on how heavy the soil load is. Shown in FIG. 5 is one cycle totalling fourteen minutes which is considered adequate for most soil conditions. In some cases, it might be desirable to have a shorter or longer cycle however, and for this purpose a variable timer controlled switch 35 may be employed rather than one having a fixed time duration.

While, in accordance with the patent statutes, there has been described what at present is considered to be the preferred embodiment of the invention, it will be obvious to those skilled in the art that various changes and modifications may be made therein without departing from the invention as, for example, open coil heater wires could be substituted for the thin film additional heaters. It is, therefore, intended by the appended claims to cover all such changes and modifications as fall within the true spirit and scope of the invention.

What is claimed is:

1. A self-cleaning glass-ceramic surface cooking unit comprising:

a glass-ceramic planar surface having at least one cooking area adapted to support a cooking utensil during normal cooking operation;

an electric cook heating unit mounted beneath said cooking area and spaced from said glass-ceramic surface, first circuit means for supplying electric energy to the cook heating unit to raise the surface temperature within said cooking area to normal cooking levels, additional electric heating means in contact with the glass-ceramic surface in the region adjacent said cooking area; and second circuit means for supplying electric energy to said additional heating means to provide self-cleaning action by raising the surface temperature in said region to a level sufficient to remove baked-on food soils deposited within said region during one or more prior cooking operation.

2. The cooking unit of claim 1 in which the second circuit means is adapted to operate said additional electric heating means only when the cook heating unit is not in operation.

3. The cooking unit of claim 1 in which the second circuit means includes circuit interruption means for automatically preventing operation of the cooking heating unit during operation of the additional heating means.

4. The cooking unit of claim 1, 2, or 3 in which the second circuit means includes means operable simultaneously with energization of the additional heating means to indicate that the self-cleaning action is occuring.

5. The cooking unit of claim 1, 2 or 3 in which the additional heating means extends around substantially all of the periphery of the at least one cooking area.

6. The cooking unit of claim 1 in which the additional heating means comprises at least one continuous thin film heater bonded to the undersurface of the glass-ceramic surface.

7. The cooking unit of claim 6 in which the second circuit means includes an indicator bulb connected in parallel circuit with the at least one thin film heater to provide a visual indication of the operation of the film heater.

8. A self-cleaning ceramic surface cooking unit adapted for connection to a source of electric energy comprising:

a glass-ceramic planar surface having a plurality of discrete cooking areas adapted to support cooking utensils during a normal cooking operation;

an electric cooking heater mounted underneath each cooking area;

first circuit means, including an interlock switch for connecting each of the cooking heaters to said source of electric energy, for raising the surface temperature of the corresponding cooking areas to that required for desired cooking operations;

an additional electric heater mounted on the side of the glass ceramic surface beneath the region adjacent each of the surface cooking areas; and second circuit means for connecting each of the additional heaters to the source of electric energy to raise the temperature of the ceramic surface in said regions to a level sufficient to remove baked-on food soils deposited in said regions during one or more prior cooking operations said second circuit means including a switch connected in series with the additional heaters and means responsive to closing of the last mentioned switch to open said interlock switch, whereby initiation of the cleaning operation automatically disables the cooking heaters.

9. The cooking unit of claim 8 in which said interlock switch comprises switch contacts of a hot wire relay and said switch responsive means comprises the activator wires of said relay.

10. The cooking unit of claim 9 in which the additional heaters are low impedance thin film heaters connected in series with each other to the energy source through the activator wires of said relay, a high impedance neon discharge indicator bulb connected in parallel with the thin film heaters and in series with said relay activator wires, the activator wires having an impedance intermediate that of the thin film heaters and the neon bulb so that the neon bulb is normally unlit during cooking operations and so that a break in the glass-ceramic surface in the region of a thin film heater will interrupt the thin film heater branch of said parallel circuit and cause the lamp to light during cooking operations and thus automatically indicate a defective glass-ceramic cooking surface.

11. The cooking unit of claim 10 in which the impedance of the indicator bulb is sufficient to reduce the current through the activator wires, when said break in the glass-ceramic surface occurs, to a level sufficient to open said interlock switch thereby disabling the cooking heaters.

12. The cooking unit of claim 8 in which the switch of said second circuit means used to initiate the cleaning operation comprises a timer-operated switch having a fixed closure time adequate to insure cleaning of normal baked-on food soil loads.

13. The cooking unit of claim 8 in which the switch of said second circuit means used to initiate the cleaning operation comprises a timer operated switch having a variable closure time to enable the user to select the cleaning time appropriate for the particular baked-on food soil load to be cleaned.

* * * * *

UNITED STATES PATENT AND TRADEMARK OFFICE

CERTIFICATE OF CORRECTION

PATENT NO. : 4,251,716

DATED : February 17, 1981

INVENTOR(S) : Walter E. Lewis/Bohdan Hurko

It is certified that error appears in the above-identified patent and that said Letters Patent are hereby corrected as shown below:

Claim 8, Col. 5, line 18, after "heaters" insert --simultaneously--.

Signed and Sealed this

*Seventh* Day of *July 1981*

[SEAL]

*Attest:*

RENE D. TEGTMEYER

*Attesting Officer*

*Acting Commissioner of Patents and Trademarks*